US005816424A

United States Patent [19]

Cannan, Jr. et al.

[11] Patent Number: 5,816,424

[45] Date of Patent: Oct. 6, 1998

[54] RETROFIT UNDERGROUND STORAGE TANK

[75] Inventors: Edward B. Cannan, Jr., Conroe; Michael Blackmar, New Caney; Edgar Clifford Crosby, III, Conroe; Larry D. Lumpkin, Conroe; John C. King, Conroe; Stephen C. Macy, The Woodlands; William A. Schneider, Conroe, all of Tex.

[73] Assignee: Fluid Containment, Inc., Conroe, Tex.

[21] Appl. No.: 543,505

[22] Filed: Oct. 13, 1995

Related U.S. Application Data

[63] Continuation of Ser. No. 508,215, Jul. 27, 1995, abandoned, which is a continuation of Ser. No. 389,298, Feb. 16, 1995, abandoned.

[51] Int. Cl.[6] ..... B65D 69/00

[52] U.S. Cl. ..... 220/4.12; 220/23.9; 206/582

[58] Field of Search ..... 220/470, 23.9, 220/4.12, 4.11, 4.16, 4.17; 206/582

[56] References Cited

U.S. PATENT DOCUMENTS

| | | | |
|---|---|---|---|
| 1,076,382 | 10/1913 | Maloney | 220/4.17 |
| 1,500,917 | 7/1924 | Bell | 220/4.09 |
| 2,337,058 | 12/1943 | McKee | 220/4.16 |
| 2,861,277 | 11/1958 | Hermann | 220/4.16 |
| 3,291,437 | 12/1966 | Bowden et al. | 220/4.11 |
| 3,874,505 | 4/1975 | Mirarchi et al. | 206/582 |
| 4,405,048 | 9/1983 | Peake | 206/582 |
| 4,820,564 | 4/1989 | Cologna et al. | 206/582 |
| 4,890,375 | 1/1990 | Browning | 206/582 |
| 5,054,035 | 10/1991 | Kolom | 220/4.16 |
| 5,183,178 | 2/1993 | Flemming | 206/582 |

*Primary Examiner*—Joseph M. Moy
*Attorney, Agent, or Firm*—Crowell & Moring LLP

[57] ABSTRACT

The present invention is directed to a retrofit underground storage tank (30) and method for making the same. A portion of an underground primary tank (32) its uncovered and an access opening (42) in formed therein. A plurality of trifolds (50, 120, 122, and 124) comprising three folded up and banded together panels (52, 54, 56) which are jointed together by hinges are inserted into the primary tank. A monorail or conveyor (90) is inserted into and suspended from above the primary tank (32). Trolleys (102, 104) on the monorail (90) assist in transporting the trifolds (50, 120, 122 and 124) within the primary tank (32) and then the monorail (90) is removed. Trifolds (50, 120, 122 and 124) are unbanded and unfolded and are arranged circumferentially about the tank. Jack stands are used to hold panels of the trifolds in place. Circumferential and longitudinal joints are formed between abutting edges on the panels using fiberglass reinforced plastic mats, woven rovings and resins layups thus creating an inner cylindrical wall (230) within primary tank (32). Further panels are joined together to form a pair of end caps (260, 300) which are jointed to inner cylindrical wall (330) thus creating an inner tank (312). The access opening (42) in primary tank (32) is then covered with a panel which is sealed to primary tank (32). The inner tank and outer primary tank (32) cooperate to form retrofit double walled storage tank (30). Brine, pressure, vacuum, or a dry monitor are installed between the inner and outer tanks to allow monitoring of the tank. In a second embodiment, double wall and or single wall panels are joined together to construct a multi-walled inner tank within an outer primary tank to create a retrofit tank (30').

13 Claims, 8 Drawing Sheets

RETROFIT UNDERGROUND STORAGE TANK

CROSS-REFERENCE TO RELATED APPLICATIONS

This is a continuation of application Ser. No. 08/508,215, filed on Jul. 27, 1995, now abandoned, which is a continuation of application Ser. No. 08/389,298, filed on Feb. 16, 1995, now abandoned.

BACKGROUND OF THE INVENTION

This invention relates generally to underground storage tanks, and more particularly, to the retrofitting of storage tanks by placing a secondary liner within a primary underground tank.

Some underground storage tanks can corrode (i.e. bare steel) and poorly installed tanks may leak over time. When this occurs, the tank must be replaced or repaired. The removal and replacement of underground storage tanks may be very expensive due to shoring, backfilling, and other construction costs. There are also instances, where for environmental or liability reasons, the tank owner may choose to upgrade tanks to secondarily contained tanks. Replacement is expensive.

Several suggestions have been made as how to retrofit or upgrade tanks using a secondary container or liner. For example, U.S. Pat. No. 5,261,764 to Walles, discloses installing at least one plastic coating within an existing tank to form a resultant double walled tank. Trussler, U.S. Pat. Nos. 5,060,817 and 5,102,005 provide external containment capsules which surround existing underground storage tanks. Jones, U.S. Pat. No. 3,167,209, teaches providing a flexible tank liner within an outer rigid tank. Other repairs methods include simply applying a coating of polyester or epoxy to the inside of a tank.

However, each of the methods has drawbacks for example, simply applying a coating of material on the inside of a tank produces a secondary tank or container which has little independent structural strength apart from the surrounding outer tank. In the event the outer tank corrodes or otherwise degrades sufficiently so that the outer tank cannot withstand the internal or external forces on the outer tank, it is desirable that the inner secondary tank have significant strength of its own. Further, providing a structurally sound inner tank allows for pressure monitoring of the annulus space created between the tanks using air or liquid as the annular space monitoring medium.

Placing a secondary containment vessel about the outside of an underground outer tank requires that all of the outer tank be exposed. This complete exposure of the tank from a covering layer of soil requires a great deal of work and expense.

The present invention has been developed to overcome the above cited deficiencies by providing a secondary or inner tank within a primary or outer tank. The secondary tank has significant self support or rigidity and requires a minimal amount of work to install within the outer tank.

OBJECTS OF THE INVENTION

It is an object of the present invention to provide a secondary or inner tank within a preexisting primary underground tank to create a retrofitted storage tank wherein the secondary tank has significant self support apart from the primary tank.

A further object is to provide a plurality of hinged panels which are folded together for insertion into an access opening in a primary tank and are then unfolded to cover significant portions of the inner periphery of the primary tank whereby the panels can be joined together using a minimal number of joints thus saving assembly time and expense.

Still an additional object is to construct a tank within a tank to form a tank with an annular space defined therebetween which can be manually or electronically monitored for leakage.

SUMMARY OF THE INVENTION

A method for retrofitting an underground primary storage tank located beneath a covering layer is disclosed. The method comprises the following steps. A portion of an underground primary tank is uncovered from a covering layer. An access opening is cut in the primary tank. A plurality of rigid prefabricated panels are inserted into the primary tank through the access opening. The panels are arranged about the inner surface of the primary tank with edges of the panels adjacent one another. The adjacent edges of the panels are laid up with fiberglass reinforced plastic mats and resins to form joints between the panels. The resins in the joints are allowed to cure creating a fluid tight inner tank within the primary tank.

Preferably, the panels include an arcuate rectangular segment and at least one reinforcing rib secured thereto. The panels can be of varying widths and lengths to accommodate existing outer tank internal fittings, flanges, lips, edges, welds, rings, offsets, diameter changes, humps, or any other protuberances or non-cylindrical conditions on the inner surface of the primary tank. Ideally, the insertion of the plurality of rigid panels includes securing at least two panels together prior to their insertion so that the at least two panels are inserted through the access opening at the same time. The panels may be secured together by one or more hinges to form a trifold.

The method may also include laying up the ribs on the panels to form a circumferentially continuous integral reinforcing hoop extending 360 degrees about the tank. Jack stands may be used to hold the panels flush against the inner surface of the primary tank during the forming of joints between the panels.

The method may optionally include using a conveyor system within the primary tank to transport the panels within the primary tank. Also optionally, a monitoring system can be installed into the space between the inner tank and the outer tank to fluidly monitor the space created therebetween by the formation of the inner tank within the outer tank.

An insert for use in retrofitting a storage tank is also described. The insert comprises first and second arcuate fiberglass panels and at least one hinge connecting the first panel to the second panel. The panels can be folded together to form a compact configuration and can be unfolded to form a larger combined arcuate surface.

A retrofit tank is also provided comprising an outer primary tank having an inner surface, a plurality of discrete arcuate fiberglass panels arranged within the outer primary tank to line the inner surface of the outer primary tank, and a plurality of layup joints affixing the arcuate panels together. The layup joints and arcuate panels cooperate to form a fluid tight inner tank within the outer primary tank. The panels may be laid up and joined together to form a multi-walled tank within the primary tank. A monitoring apparatus may be disposed between the inner tank and the outer tank to monitor the leakage of fluid in the space located between the inner and outer tanks.

DETAILED DESCRIPTION OF PREFERRED EMBODIMENTS

Figure 12:
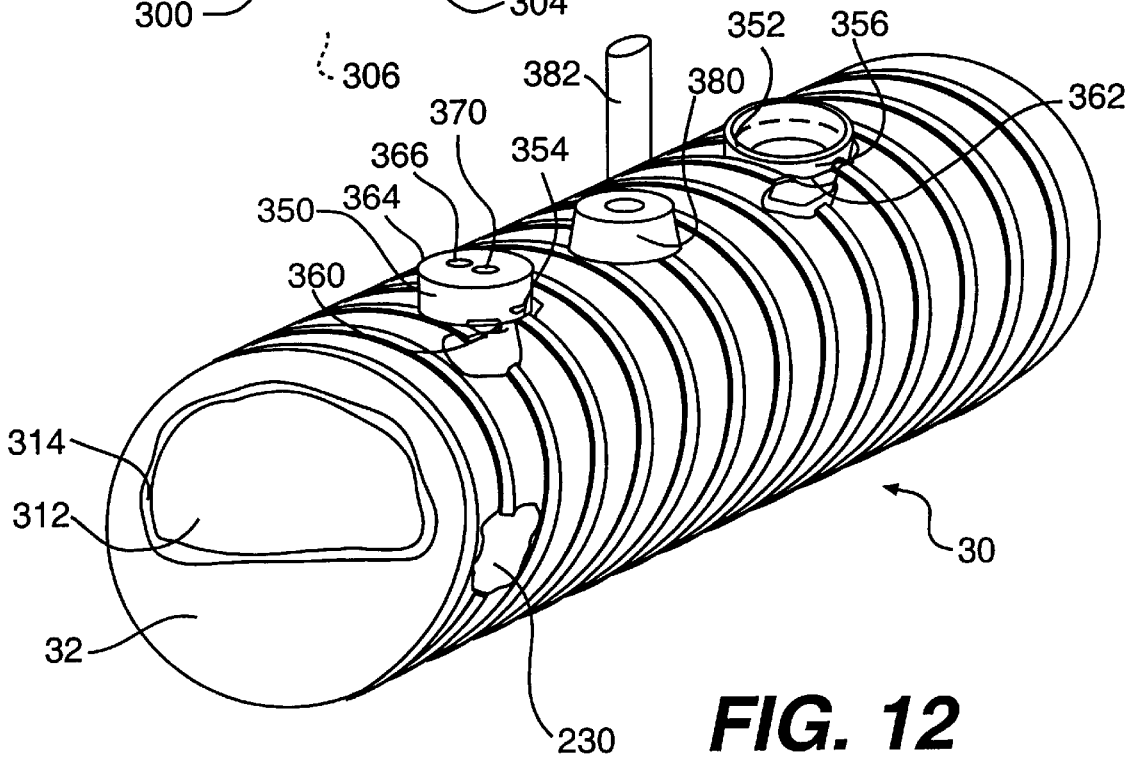
FIG. 12 is a perspective of the retrofitted storage tank of the first embodiment which includes the outer primary tank and the inner secondary tank.

The present invention is directed toward retrofit underground storage tanks 30 and 30' and methods for making the same. Retrofit tank 30 is shown in FIG. 12 in its completed state. In a first embodiment, a plurality of discrete trifolds of panels and end panels are inserted into a primary tank 32 and are joined together to form a fluid tight inner tank. These retrofit tanks 30 and 30' and methods for making the same will now be described in more detail.

Figure 1:
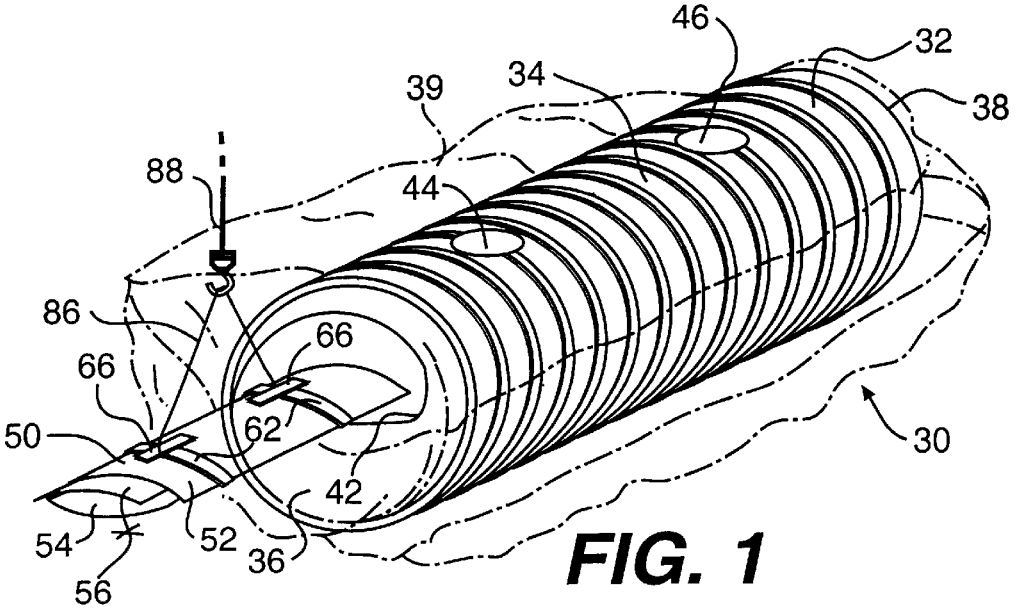
FIG. 1 is a perspective view of a trifold of panels being inserted into a primary tank which is to be retrofitted into the single walled storage tank in accordance with a first embodiment of the present invention.

FIG. 1 illustrates a primary tank 32 which is to be retrofitted, in accordance with the present invention, into retrofit tank 30. Primary tank 32 has a cylindrical wall 34 and a pair of longitudinally spaced apart domed rear and forward end caps 36 and 38. Tank 32 is shown with a plurality of circumferentially extending support ribs on its external surface. In this exemplary first embodiment, the diameter of tank 32 is 8 feet and its length is 30 feet, with a capacity of 10,000 gallons. Other tanks may range from 4 to 12 feet in diameter, preferably accommodating a tank having a 92 or 96 inch diameter. Four to twelve panels may be used to cover the circumference of the primary tank, six panels may be used in a preferred embodiment. Of course, this method of retrofitting tanks applies to tanks of various other sizes as well. The primary tank can also have flat end caps and no circumferential external support ribs as is common with steel tanks.

First, preexisting underground primary tank 32 is at least partially uncovered from surrounding soil 39. The top surface of cylindrical wall 34 and at least one end, such as end cap 36, are exposed. A large access opening 42 is cut into the upper half of end cap 36. Likewise, unless they previously exist, a pair of longitudinally spaced apart top openings 44 and 46 are cut into cylindrical wall 34. Access opening 42 is sufficiently large to receive end cap panels, which are joined together to form an inner end cap 48, and trifolds of rectangular, arcuate panels therethrough. Top openings 44 and 46 are sized to easily allow a work person to pass therethrough to access the interior of primary tank 32.

Figure 2:
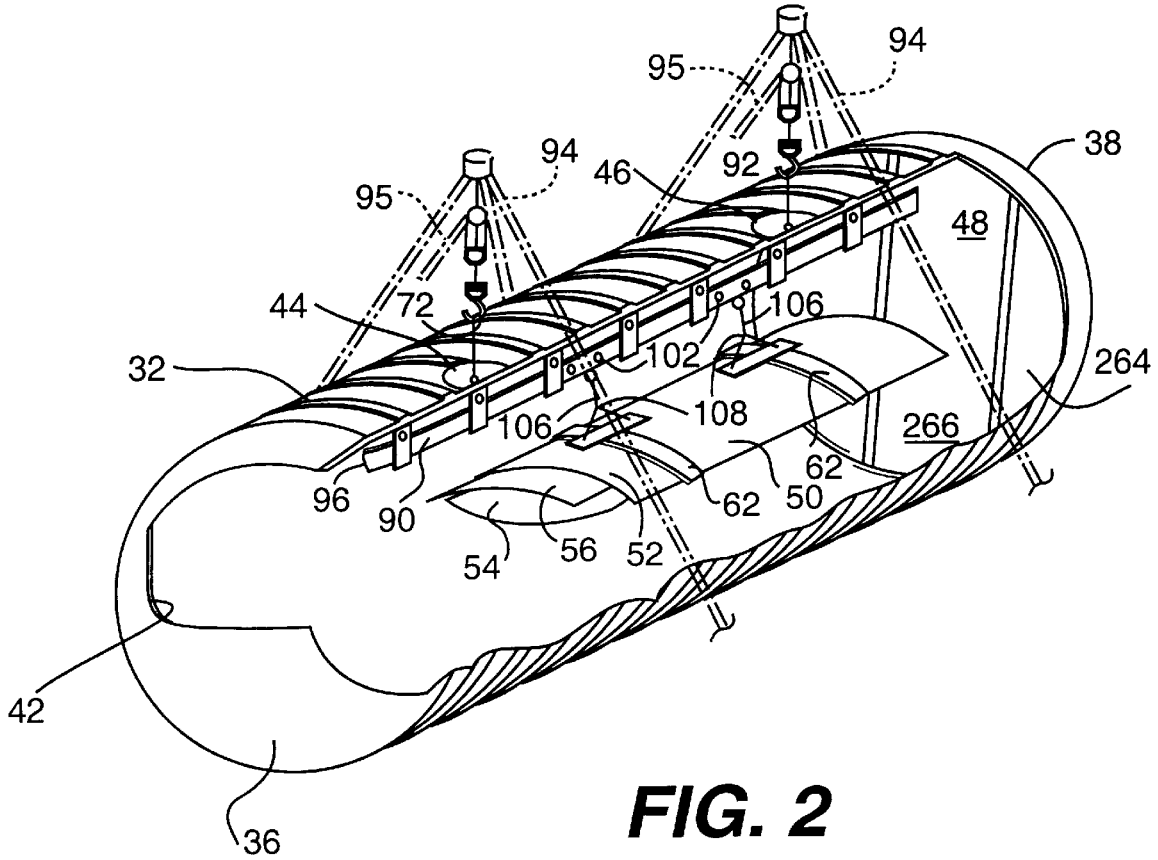
FIG. 2 is a perspective view, partially in cutaway, of the trifold being transported within the primary tank on a monorail.

End cap 48 is shown in FIGS. 2 and 12. End cap 48 may be laid up either before or after the remainder of the inner tank is installed, although preferably before. Details regarding end cap 48 will described later.

Figure 13:
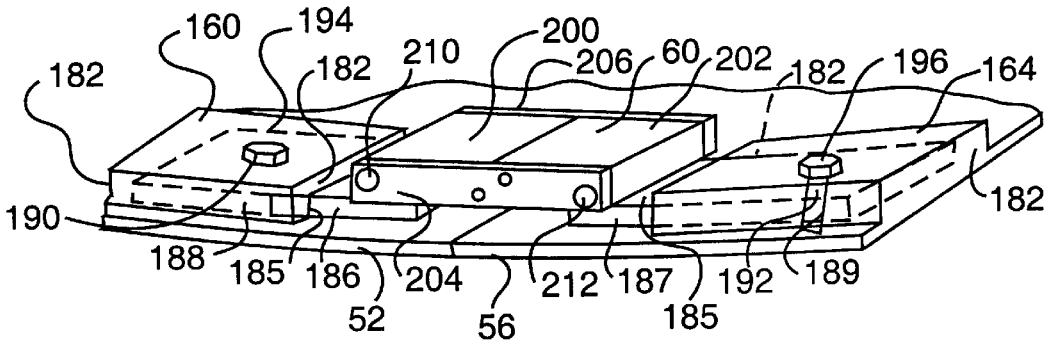
FIG. 13 is a perspective view of an exemplary hinge used to join adjacent panels together in forming a trifold.

A first trifold 50 is one of four such trifolds used in this exemplary embodiment. With a smaller tank possibly only two trifolds would be required. With larger, longer tanks more trifolds may be required. Trifold 50 comprises a pair of lateral panels 52 and 54 joined to a center panel 56 using four hinges 60, which are not shown in FIG. 1. An individual hinge 60 is illustrated in FIG. 13. Trifold 50 is shown in greater detail in FIG. 5 and will be also described in greater detail later as will be hinge 60. A pair of longitudinally spaced apart bands 62 are strapped about the periphery of trifold 50 to maintain panels 52, 54 and 56 in a compact folded up state. Bands 62 are preferably made of steel.

Figure 16:
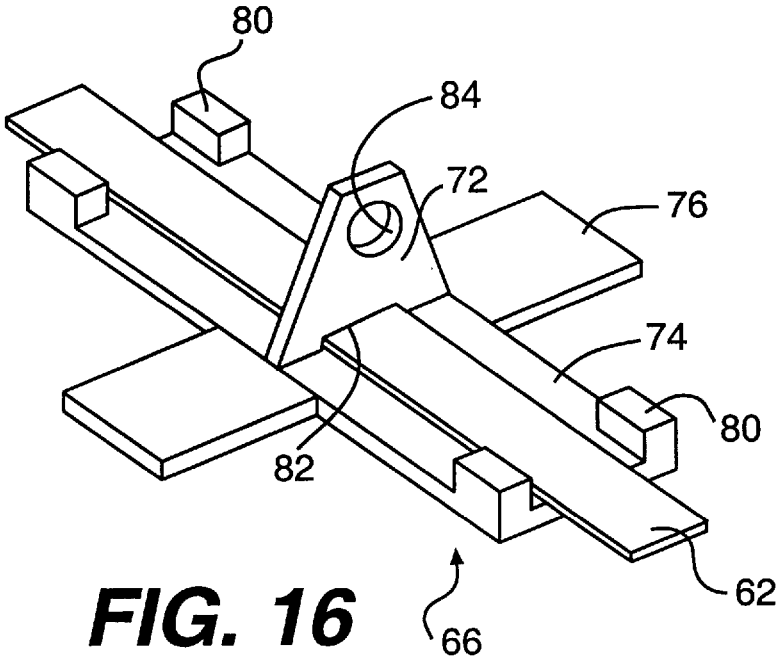
FIG. 16 is a perspective view of holder used to retain a strap which keeps a trifold folded up during transport of the trifold.

A pair of generally identical holders 66 are used in lifting and transporting trifold 50. As best seen in FIG. 16, a holder 66 has a triangular vertical web 72 attached to horizontally extending and crossing flat bare 74 and 76. Bar 74 extends circumferentially and has two pair of guide blocks 80 thereon for guiding one of straps 62. Bar 76 extends longitudinally. An opening 82 is formed in web 72 which allows strap 62 to circumferentially pass through web 72 along the top of bar 74 and between guide blocks 80. An eyelet 84 is located in the top of web 72 to receive a hook or clevice for lifting holder 66.

A monorail 90, shown in FIG. 2, is inserted through access opening 42 into primary tank 32 prior to inserting trifold 50. A pair of cables 92 are fed through top openings 44 and 46 suspending monorail 90 along the top of primary tank 32. Cables 92 are supported by respective tripods 94 and pulleys 95 located above primary tank 32. Monorail 90 has a hollow rectangular track 96 with a vertical slot located in the bottom thereof. A pair of trolleys 102 travel back and forth within track 96 and carry respective cables 106 having devises 108 thereon which are releasably attachable to eyelets 84 of holders 66 to longitudinally transport trifold 50.

Returning to FIG. 1, bands 62 hold trifold 50 in a folded, compact state. Holders 66 receive bands 62 through their web openings 82. The ends of bands 62 are secured together using clamps not shown. A support cable 86 with hooks or devises at either end thereof attaches to the eyelets 84. Cable 86 may be supported by cable 88 attached to a crane, a hoist, or a bucket of a backhoe or the like which is not shown, and is used to lift and horizontally transfer trifold 50 into access opening 42. Alternatively, rather than using cable 86, a single sling could be wrapped about the center of trifold 50 to support trifold 50 in a balanced manner. This sling could then be moved to transport trifold 50.

A first or forward end of trifold 50 is fed into access opening 42. Cable 86 is disconnected from the forward holder 66 and clevice 108 which is suspended from the forward most trolley 102. Cable 88 then may be directly attached to the rear holder 66. Trifold 56 is then fed further into primary tank 32 until the rear holder 66 is adjacent access opening 42. The second or rearward most clevice 108, suspended from the other trolley 102, is then attached to rearward holder 66 in place of cable 88.

Trifold 50 is conveyed on trolleys 102 adjacent to the forward end cap 38. Monorail 90 is then lowered by pulleys 95 from tripods 94 until first trifold 50 rests upon the floor of primary tank 32 adjacent forward end cap 38. Clevises 108 are detached from forward and rear holders 66 and monorail 90 is again raised adjacent the roof of primary tank 32.

Figure 3:
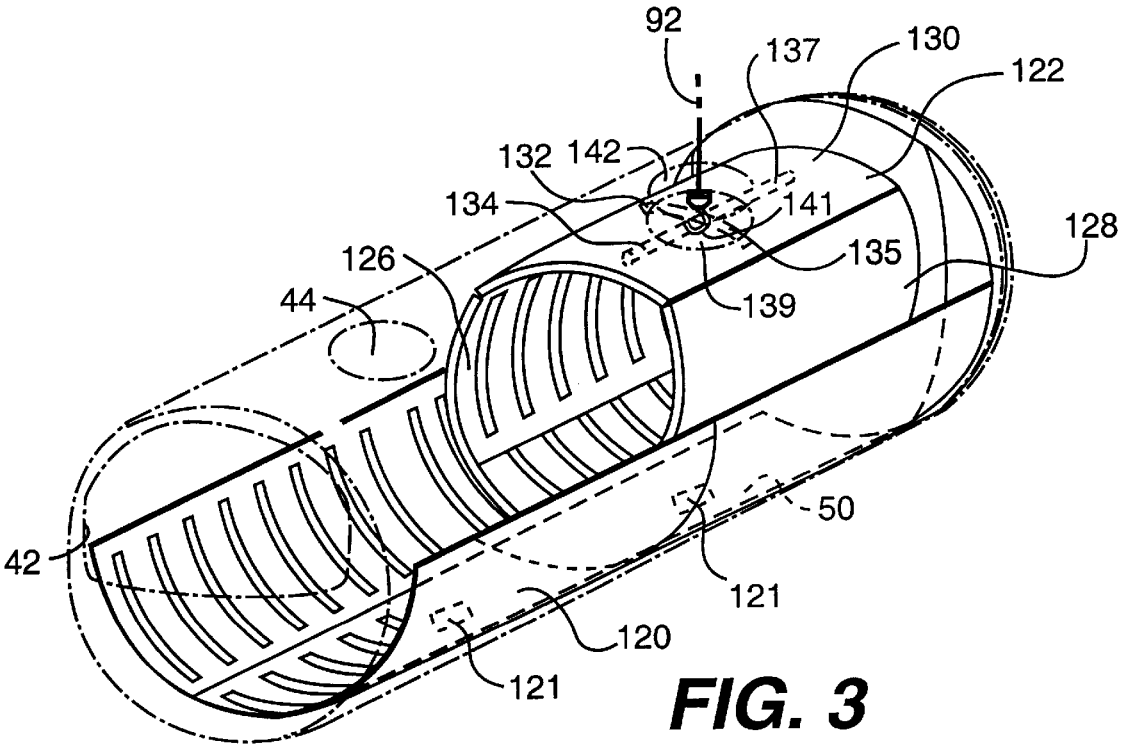
FIG. 3 is a perspective view, partially in cutaway, of a pair of trifolds lining the floor portion of the primary tank and another trifold being lifted against the roof of the primary tank.

Bands 62 are removed from trifold 50. Next, trifold 50 is unfolded with panels 52, 54, and 56 resting flushly upon the curved lower half or floor of primary tank 32. This trifold transporting process is repeated with a second trifold 120 being inserted into primary tank 32 in the manner just described. However, second trifold 120 is positioned adjacent rear end cap 36 on the floor of primary tank 32. Trifold 120 is unbanded and unfolded flushly covering the rear half of the floor of primary tank 32. Accordingly, unfolded trifolds 50 and 120 cover the lower half of inner cylindrical wall 34, as seen in FIG. 3. Each of trifolds 50 and 120 have a steel deflector plate 121, approximately 24"×24", which is encapsulated in plies of fiberglass and resin. Deflector plates 121 prevent dip rods, which measure depth of fluid in the tank, from passing through the fiberglass panels.

A third trifold 122 is next transferred into primary tank 32 in a similar manner as trifold 50 and 120. Trifold 122 is placed atop first trifold 50. Finally, a fourth trifold 124 is placed into primary tank 32 and placed upon second trifold 120 adjacent rear end cap 36. Trifolds 122 and 124 are then unbanded. As monorail 90 is no longer needed, monorail 90 is removed from primary tank 32 through access opening 42.

Each of trifolds 122 and 124 have respective lateral panels 126 and 128 and a center panel 130 with a circular opening 132 formed therein. Centering lifting devices 134 are placed into respective openings 132 of trifold 122 and 124 to lift these trifolds. Centering lifting device 134 may be placed into openings 132 either before or after trifolds 122 and 124 have been placed inside primary tank 32.

Figure 17:
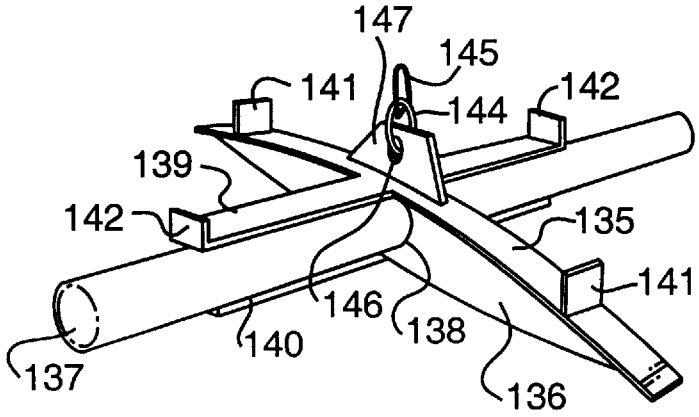
FIG. 17 is a perspective view of a lifting device used to a trifold against the roof of the primary tank.

An individual lifting device 134 is beat seen in FIG. 17. Lifting device 134 includes an upper arcuate plate 135 and a support web 136 which welded beneath arcuate plate 135. A pipe 137 extends longitudinally through an opening 138 in support web 136. Sandwiching above and below pipe 137 are longitudinally extending beams 139 and 140. Arcuate beam 135 and transverse beam 139 have respective locating prongs 141 and 142 which are sized to snugly cooperate with opening 132 of trifolds 122 and 124. A pair of clevises 144 and 145 secure to an eyelet 146 in a web plate 147 welded atop arcuate plate 135.

As shown in FIG. 3, a center panel 130 rests upon upper arcuate plate 135 and transverse beam 139. Prongs 141 and 142 keep the respective trifold centered and balanced upon lifting device 134.

A cable 92 is lowered through a respective opening 132 in trifold 122 and is attached to respective lifting device 134. Cable 92 is then raised lifting panel 130 of trifold 122 against the roof of primary tank 32. Opening 132 in trifold 122 is generally coaxially aligned with top opening 46. In a similar manner, trifold 124 is located beneath the inner upper surface of primary tank 32.

Figure 4:
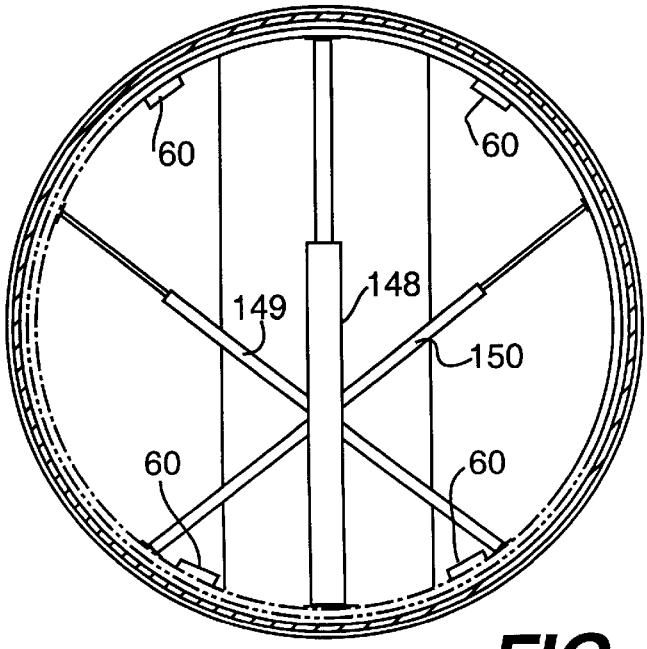
FIG. 4 is an end view showing jack stands holding individual panels of trifolds flushly against the interior of the primary tank.

A series of longitudinally spaced extensible jack stands 148, 149 and 150, as shown in FIG. 4, are used to hold trifolds 122 and 124 in place flush against the upper half of primary tank 32. With a sufficient number of jack stands in place, lifting devices 134 are no longer needed to suspend trifolds 122 and 124. Consequently, lifting devices 134 may be removed from primary tank 32.

Figure 5:
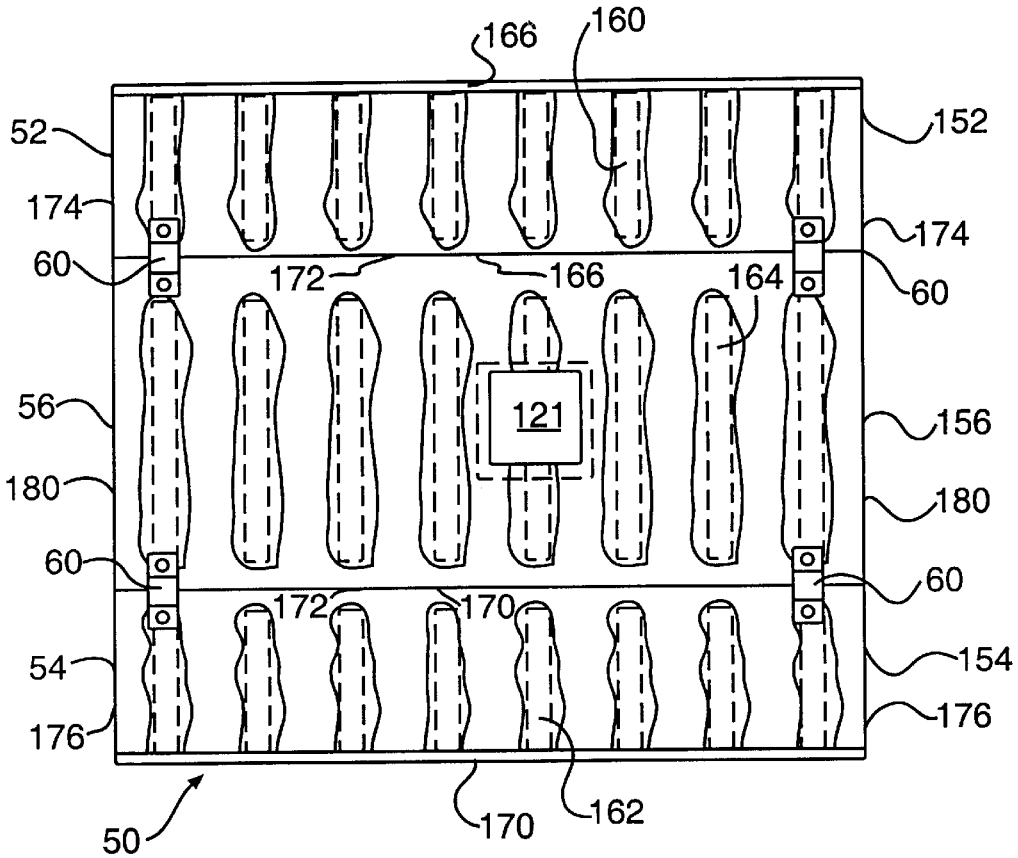
FIG. 5 is a top view of an unfolded trifold.

A plan view of unfolded trifold 50 is shown in detail in FIG. 5. Trifolds 120, 122 and 124 are generally identical with trifold 50 with the exception that trifolds 122 and 124 have openings 132 in their center panels. Trifolds 50 and 120 have deflector plates 121 which are designed to be located directly under corresponding openings 132 when all trifolds are installed. Panels 52, 54 and 56 have respective arcuate rectangular segments 152, 154 and 156 with integrally attached ribs 160, 162 and 164. Segments 152, 154 and 156 have respective parallel pairs of longitudinally extending edges 166, 170 and 172 and pairs of parallel circumferentially extending ends 174, 176 and 180. Each of panels 52, 54 and 56 can have a circumferential arc length of approximately 60 degrees.

In a preferred embodiment, some of the panels may have varying widths and lengths to accommodate existing primary tank man holes, shell joints, internal fittings, pipe couplings, pipe nipples, hubs, striker plates, flanges, lips, edges, welds, rings, offsets, diameter changes, humps, or any other protuberances, openings or non-cylindrical conditions on the inner surface of the primary tank. In order to easily fit different size existing primary tanks, the width of at least one panel may be adjusted to allow the installed panels to match the internal circumference of the primary tank. For example, a single panel may be so narrow as to only cover 7.5 degrees in arcuate length of the circumference of the tank. The length of the panels may be adjusted as well to completely or partially cover the length of the inner surface of the primary tank. In use, panels of varying widths and lengths can be used conjunctively to obtain a required fit, such as a large panel laid up with a smaller panel, such that the inner tank avoids a protuberance on the inner surface of the primary tank.

Layups, caps, overlays, finishes, or similar covers may be used to seal off the primary tank internal fittings mentioned above to provide a smoother surface before the panels are installed, while maximizing the available volume for the inner retrofit tank. Also, the inner surface of the primary tank may be smoothed out with materials having elastomeric bonding properties such as grout prior to installing the retrofit tank. These techniques provide a smoother surface on the primary tank before the panels are installed. This allows for a better fit between the primary tank and the retrofit tank and gives the retrofit tank more support.

In another embodiment, the retrofit tank may have a first panel and a second panel where both panels are single wall. The first panel has an inner surface and an outer surface and the second panel has an inner surface and an outer surface interior to the inner surface of the first single wall panel. In a first version of this embodiment, the inner surface of the first panel and the outer surface of the second panel can be smooth. In a second version, the inner surface of the first panel can be smooth and the outer surface of the second panel can have a rib. In a third version, the inner surface of the first panel can have a rib and the outer surface of the second panel can be smooth. In a fourth version, the inner surface of the first panel and the outer surface of the second panel can both have ribs.

In another embodiment, the retrofit tank may have a first panel and a second panel where both panels are double wall. The first panel has an inner surface and an outer surface and the second panel has an inner surface and an outer surface interior to the inner surface of the first panel. In a first version of this embodiment, the inner surface of the first panel and the outer surface of the second panel can be smooth. In a second version, the inner surface of the first panel can be smooth and the outer surface of the second panel can have a rib. In a third version, the inner surface of the first panel can have a rib and the outer surface of the second panel can be smooth. In a fourth version, the inner surface of the first panel and the outer surface of the second panel can both have ribs.

In another embodiment, the retrofit tank may have a first panel and a second panel where the first panel is double wall and the second panel is single wall. The first panel has an inner surface and an outer surface and the second panel has an inner surface and an outer surface interior to the inner surface of the first panel. In a first version of this embodiment, the inner surface of the first panel and the outer surface of the second panel can be smooth. In a second version, the inner surface of the first panel can be smooth and the outer surface of the second panel can have a rib. In a third version, the inner surface of the first panel can have a rib and the outer surface of the second panel can be smooth. In a fourth version, the inner surface of the first panel and the outer surface of the second panel can both have ribs.

In another embodiment, the retrofit tank may have a first panel and a second panel where the first panel is single wall and the second panel is double wall. The first panel has an inner surface and an outer surface and the second panel has an inner surface and an outer surface interior to the inner surface of the first panel. In a first version of this embodiment, the inner surface of the first panel and the outer surface of the second panel can be smooth. In a second version, the inner surface of the first panel can be smooth and the outer surface of the second panel can have a rib. In a third version, the inner surface of the first panel can have a rib and the outer surface of the second panel can be smooth. In a fourth version, the inner surface of the first panel and the outer surface of the second panel can both have ribs.

Each of ribs 160, 162 and 164 terminate approximately 5 inches from the longitudinal edges 166, 170, and 172 of their respective panels 52, 54, and 56. An exception is on center panels 56 which have deflector plates 121. There, ribs 164 terminates at the edge of the deflector plate layups. Ribs 160, 162 and 164 each include elongate plastic forms 182 which are hollow and are generally trapezoidal in shape. The base of the trapezoid lies adjacent the arcuate segments having a width of approximately 5 inches and top being approximately 4 inches with an overall form height of approximately 1 inch. Plastic forms 182 are attached to panels 52, 54 and 56 using fiberglass reinforced plastic mats and woven roving and polyester resins to form layups 184 as is conventional in the art of fiberglass reinforced plastic tank construction. The forms can also be attached using layups of fiberglass mat and an appropriate resin. Examples of such resins include isophthalic polyester and other polyester, vinyl ester, epoxy resins, teraphthalic or tetraphthalic and orthophthalic or other resin systems.

To construct each panel, a complete cylindrical wall may first be made and then the separate arcuate segments 152, 154 or 156 of each of the trifolds are cut therefrom. Alternatively, arcuate male or female molds or mandrels may be used to form each of the individual arcuate segments 152, 154, or 156. Preferably, the arcuate panel segments 152, 154, or 156, have an arcuate length between 30 degrees and 90 degrees or an arcuate length between 45 degrees and 75 degrees. The arcuate length can be as small as 7.5 degrees. After segments 152, 154, and 156 have been made, ribs 160, 162 and 164 are added thereto using the forms 182 and the overlying layups 184. It is much easier to layup the ribs 160, 162 and 164 during construction of panels 52, 54 and 56 at a manufacturing facility as compared to installing the ribs within primary tank 32 at the job site.

Two pairs of hinges 60 are used to secure panels 52, 54 and 56 together. An exemplary hinge 60 attaching to a pair of ribs 160 and 164 is shown in FIG. 13. A pair of circumferentially spaced curved plates 186 and 187 which generally match the curvature of panels 52, 54, and 56, extend into rectangular openings 185 formed in hollow plastic forms 182 of ribs 160 and 164. Each of plates 186 and 187 has a respective tapped hole 188 and 189 therein. Apertures 190 and 192 are created in ribs 160 and 164. Bolts 194 and 196 are inserted through apertures 190 and 192 in ribs 160 and 164 and are threadedly received in tapped holes 188 and 189 in plates 186 and 187 to secure hinge 60 to panels 52 and 56.

Welded to the inboard ends of plates 186 and 187 are blocks 200 and 202. Blocks 200 and 202 are laterally sandwiched by a pair of longitudinally spaced plates 204 and 206. Hinge pins 210 and 212 pass through respective blocks 200 and 202 and sandwiching plates 204 and 206. Consequently, block 202, associated plate 187 and panel 56 can fold relative to panel 52. In a similar fashion, all the panels of trifolds 50, 120, 122 and 126 can be folded with respect to other panels in their corresponding trifold to be placed into a compact folded configuration for insertion into access opening 42.

Figure 6:
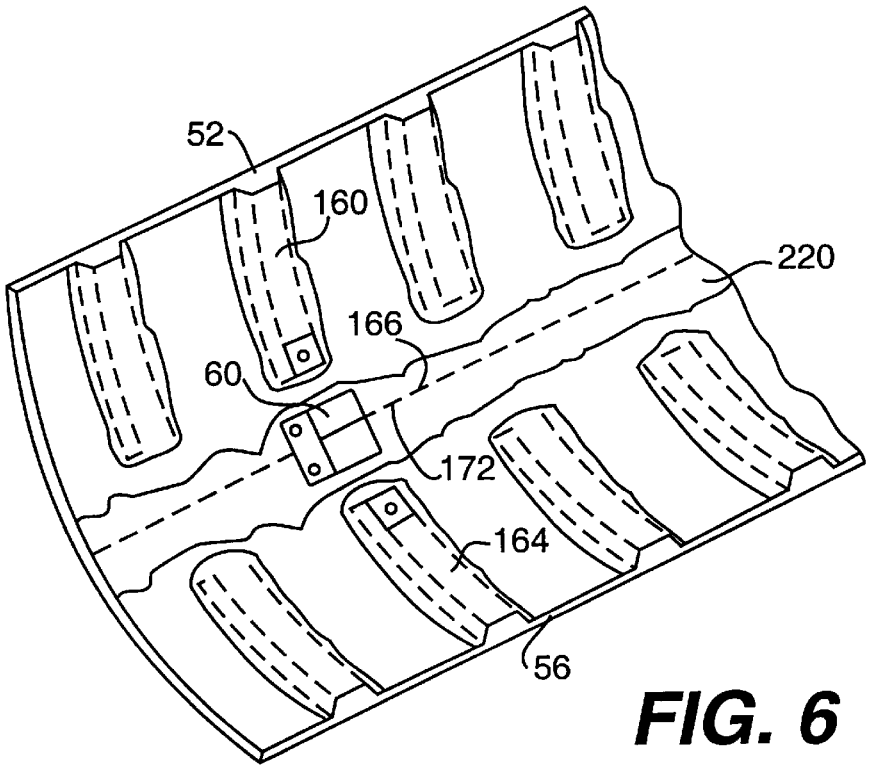
FIG. 6 is a fragmentary perspective view of a discontinuous longitudinal joint, including a hinge, formed between adjacent panels of a trifold.

All gaps between edges of adjacent panels are filled with a fiberglass reinforced polyester (FRP) "putty", such as Cabosil polyester resin mixture with milled fibers, and are allowed to harden. FIG. 6 shows a panel 52 attached to a panel 56. Longitudinally extending edges 166 and 172 of panels 52 and 56 abut one another. After the FRP putty hardens a portion of a longitudinal joint 220 is formed by placing an elongate 3-ply "hot patch" or other number of plies of layups 222 across the top of abutting edges 166 and 172, except where hinge 60 connects panels 52 and 56 together. This process is repeated with other intermittent longitudinal joints 220 being formed between abutting longitudinal edges of the panels of trifolds 50, 120, 122 and 126.

Figure 7:
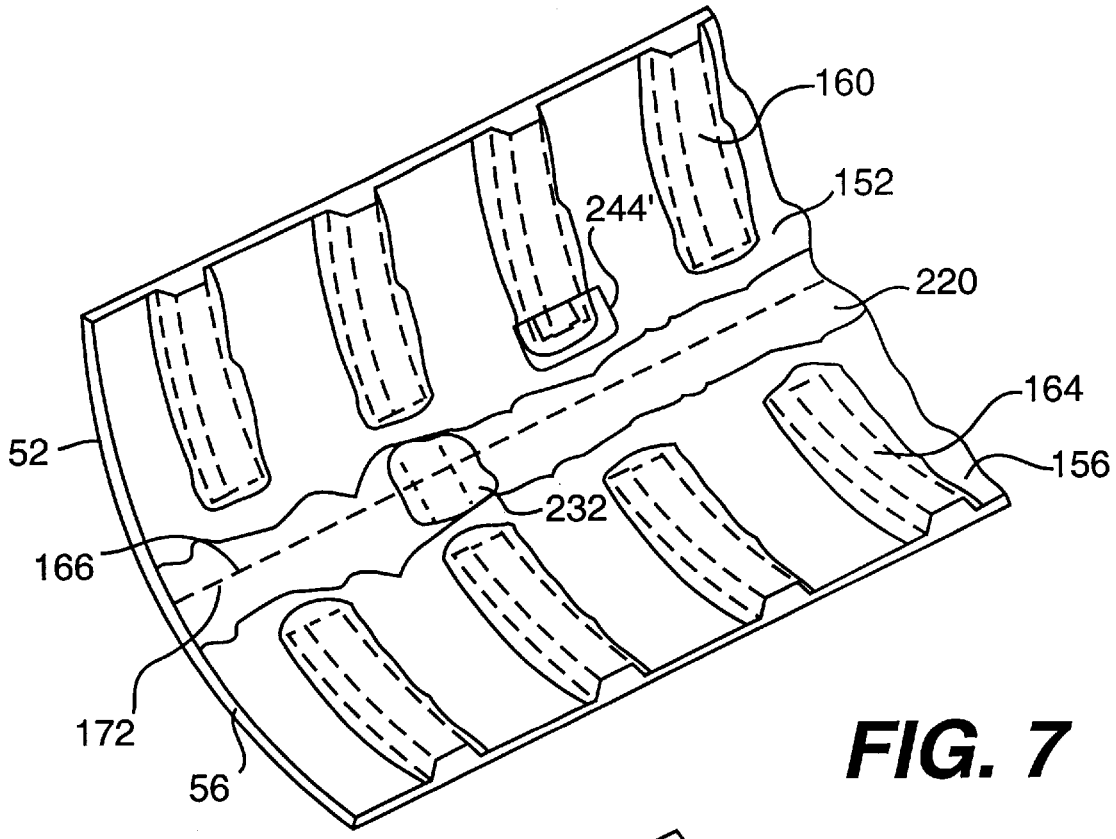
FIG. 7 is a fragmentary perspective view of the completed longitudinal joint of FIG. 6 with the hinge removed.

Looking to FIG. 7, once the 3-ply "hot patch" or other number of plies layups 222 have cured, hinges 60 are removed from trifolds 50, 120, 122, and 124. Patches of layups 232 are applied to each of the longitudinal gaps in longitudinal joints 220 where hinges 60 had previously been disposed. Six longitudinal joints 220 therefore now continuously run the length of trifolds 50, 120, 122, and 124 forming a continuous inner cylindrical wall 230.

Figure 9:
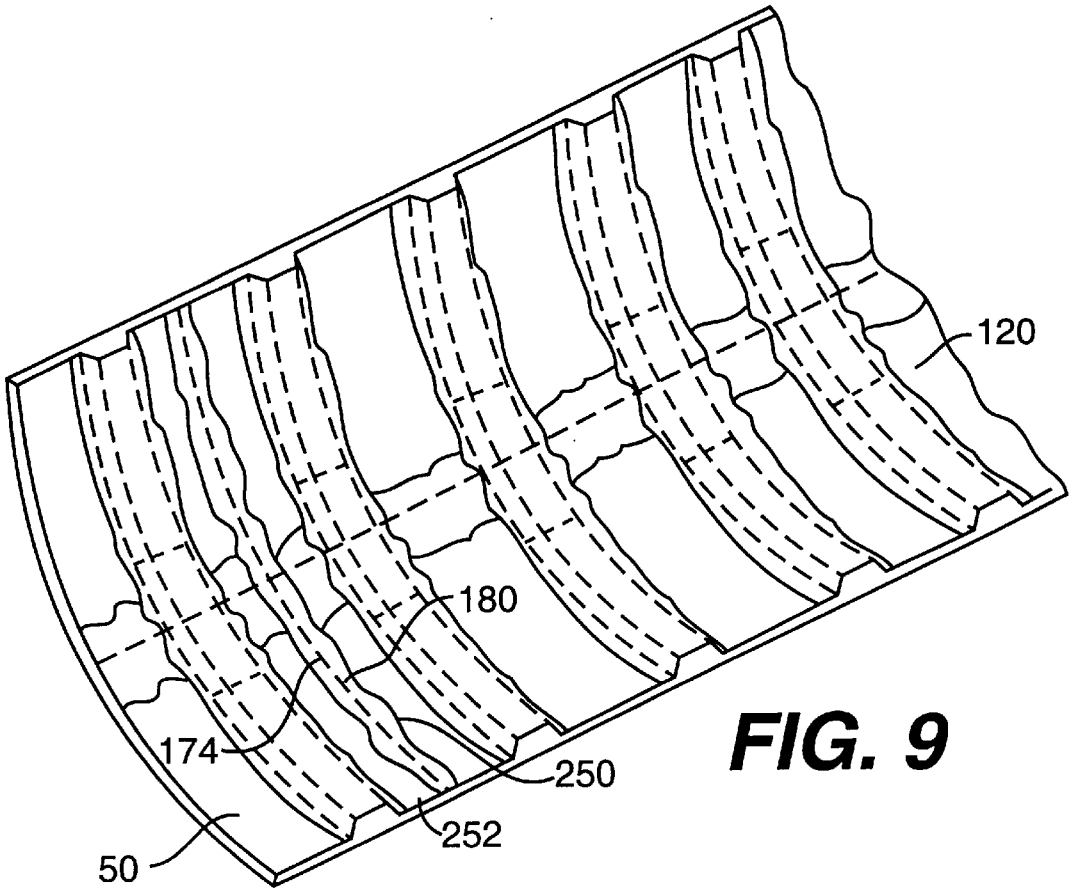
FIG. 9 is a fragmentary perspective view of a pair of longitudinally spaced panels being joined at their ends by a circumferential joint.

Next, circumferentially extending joints are formed between panels. FIG. 9 shows an exemplary circumferentially continuous joint 250 formed by applying 3-ply "hot patch" or other number of plies of layups 252 over abutting circumferentially extending edges such as edges 174 and 180. Edges 174 and 180 are found on longitudinally disposed trifolds 50 and 120. All of the panels of trifolds 50, 152, 154, and 156 are similarly circumferentially joined. Consequently, both circumferentially and longitudinally extending joints of layups connect the various panels of the trifolds together.

After all "hot patch" layups are cured, all of the jack stands 148, 149, and 150 are removed. Layups of alternating fiberglass mat/woven roving and appropriate resins are then applied on all longitudinal joints 220 and all circumferential continuous joints 250. Also, layups of fiberglass mat and polyester resin may be used to form joints 220 and 250.

Figure 8:
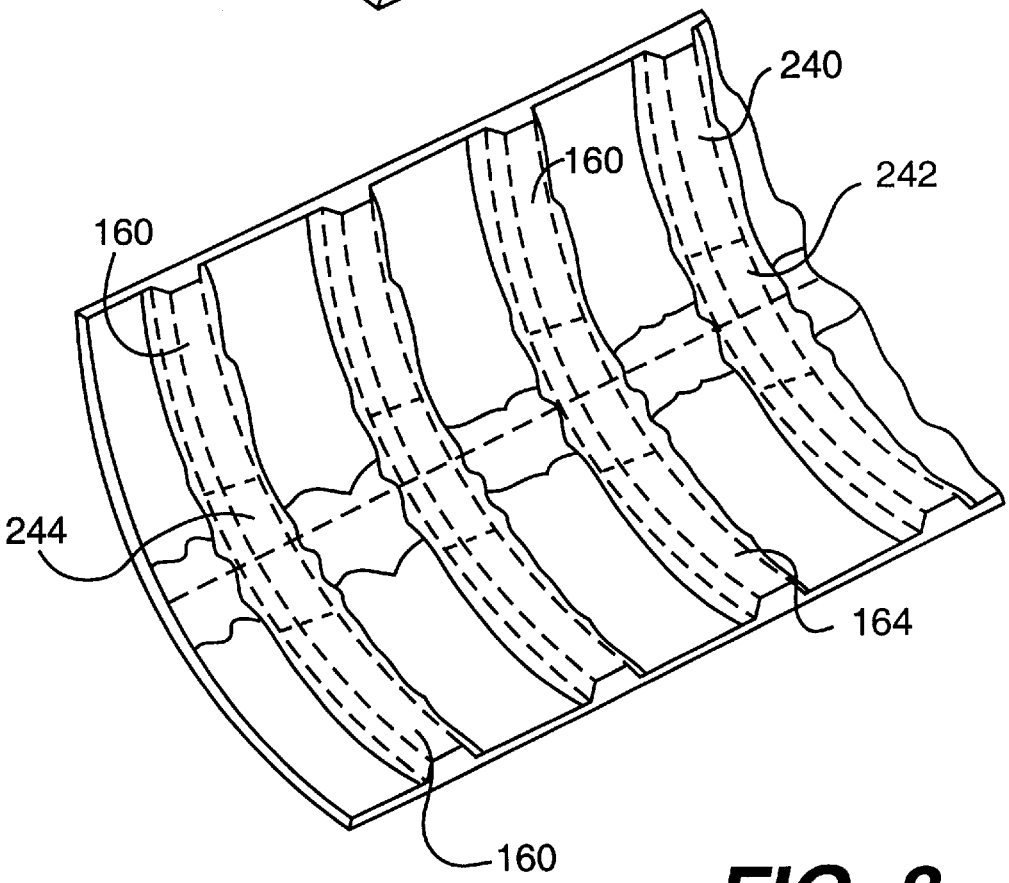
FIG. 8 is a fragmentary perspective view of rib portions laid up with ribs on adjacent panels.

FIG. 8 illustrates a preferred embodiment of the circumferential joining of ribs 160 and 164. Inserted in the circumferential gap between the ends of each of ribs 160 and 164 is a rib portion 242. Rib portions 242 are made of the same material as forms 182 which were attached to segments 152, 154 and 156 during the fabrication of panels 50, 120, 122 and 124. 5-ply or other number of plies of layups of alternating mat/woven roving 244 are applied over adjoining ribs portions 242 and ribs 160 and 164. This process of laying up ribs and rib portions 242 is continued until longitudinally spaced circumferentially continuous integral reinforcing hoops 240 of ribs and rib portions are formed throughout tank 32 The ribs forming the longitudinally spaced hoops 240 are 16 ½ inches on center in this exemplary inner wall 230. Preferably, reinforcing hoops 240 range between 10 inches and 36 inches on center, depending on the size of the particular primary tank to be retrofitted.

In an alternative embodiment, in place of rib portions 242, layup 244' comprising 21 plies or other substantial number of plies, may be applied on the ends of ribs 160 and 164 to reinforce the ribs as shown in FIG. 7. Then layup 244 can be applied over joint 220 where it may overlap the plies applied to the ends of ribs 160 and 164. This procedure of applying plies may be continued until all of the ribs and joints are adequately reinforced.

Figure 10:
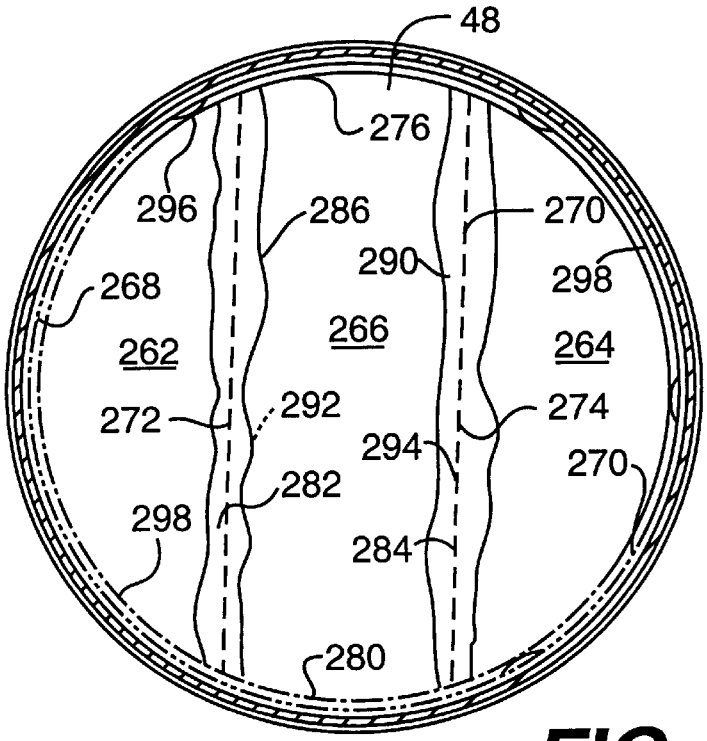
FIG. 10 is a sectional view showing a first end cap laid up within an end cap of the primary tank.

FIG. 10 shows end cap 48, sometimes referred to as a retank tank end, in greater detail. End cap 48 is positioned adjacent end cap 38 of primary tank 32 and may come in contact with the end cap 38 of the primary tank 32 depending on the shape of end cap 48. There is therefore a space formed between end cap 48 and end cap 38. End cap 48 can be installed prior to the insertion of the trifolds or after one or more panels of the trifolds have been installed.

End cap 48 may be dome-shaped, dish-shaped or flat, and includes lateral panels 262 and 264 sandwiching about a center panel 266. Panels 262, 264 and 266 are sufficiently lightweight that they can be moved manually and placed within primary tank 32 without the use of monorail 90. Panels 262, 264 and 266 are placed against end cap 38 and abut one another as shown in FIG. 10. Lateral panels 262 and 264 have respective circumferential edges 268 and 270 and vertical edges 272 and 274. Center panel 266 has a pair of spaced apart lower and upper circumferential edges 276 and 280 and a pair of vertical edges 282 and 284. Jack stands may be used to hold there panels in place prior to their being laid up together.

3-ply "hot patch" layups 286 and 290 are placed over abutting vertical edges 272 and 282 and over edges 274 and 284 to form a pair of vertical joints 292 and 294. Circumferential edges 266, 280, 270 and 276 are secured to abutting circumferentially extending edges 166, 172, and 170 of trifolds 50 and 120 using 3-ply "hot patch" layups 296 to form a circumferentially continuous head joint 298 sealingly joining domed end cap 260 to inner cylindrical wall 230. After the layups have cured, jack stands are removed. Then, a 10 ply, or other number of plies is placed over layups 286, 290 and 296.

Figure 11:
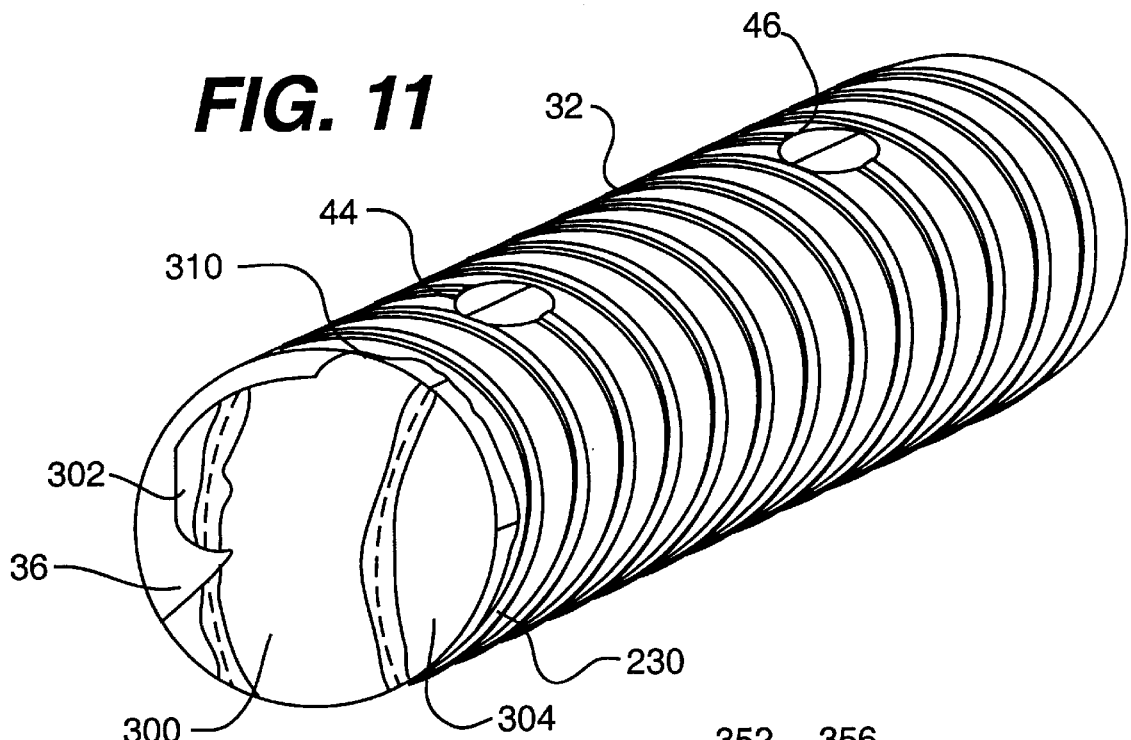
FIG. 11 is a perspective view, partially cutaway, of a second end cap laid up inside the other end cap of the primary tank.

Referring now to FIG. 11, an end cap 300 similar to end cap 260, is added to inner wall 230 adjacent rear end cap 36 of primary tank 32. End cap 300 comprises panels 302, 304 and 306 which are joined to each other and to inner wall 230 using layups. These layups are applied on the inside of end cap 300. Inner cylindrical wall 230 and end caps 260 and 300 cooperate to form a fluid tight inner tank 310, leaving a space between end cap 36 and end cap 300. As shown in FIG. 12, a panel 312 of fiberglass reinforced plastic is used to cover access opening 42 in primary tank 32. Layups 314, applied on the exterior of primary tank 320, are used to secure panel 312 over access opening 42.

The space between the end caps of the primary tank and the inner tank may be filled with water, brine, anti-freeze, or any suitable liquid. Brine, anti-freeze, or any other material resistant to freezing may be used as fill to prevent freezing of the contents in the annular space between the primary tank and the retrofit tank in climates where freezing temperatures are a problem. Liquid fill materials may also be used to monitor the annular space between the primary tank and the retrofit tank. The space may also be filled with sand, gravel, grout, concrete or any other suitable solid material. This type of solid material fill can add additional support to the outer tank by resisting compression.

Depending on the size of the retrofit tank, the annular space between the primary tank and the retrofit tank may vary. This space may be filled with similar materials used to fill the space between the end caps. Alternatively, a material may be used to fill the annular space that will allow the space to monitored by different means.

Finally, a pair of man ways 330 and 352 are added to complete retrofit tank 30. Layups 354 and 356 are used to secure man ways 350 and 352 to top openings 44 and 46 in primary tank 32. Likewise, layups 360 and 362 are used to secure man ways 350 and 352 to openings 132 in inner tank 312. Cover 364 is used to close off manhole 350. Openings 366 and 370 are provided in cover 364 to accommodate the filling and emptying of inner tank 310. The resulting retrofit tank is strong enough to withstand the head pressure of the water table and the brine solution that may be injected into the annular space between the inner tank and the outer primary tank.

Figure 14:
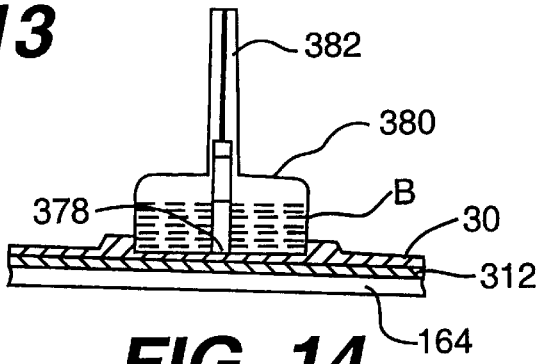
FIG. 14 is a fragmentary sectional view showing fluid integrity testing using a brine solution.

Provisions may be made for the monitoring of fluid leakage from either inner tank 312 or outer tank 32. Looking to FIG. 14, a 4", diameter hole 378 is drilled in the top of original tank 32. A fiberglass reservoir 380 is placed concentrically over this hole and fiberglass resin reinforcements are placed around reservoir 380 to seal it to the outside of tank 32. In the center of the reservoir is a preinstalled 4" diameter fitting which threadedly receives a 4" diameter, 4' high standpipe 382.

Stand pipe 382 is in fluid communication with the annular space between inner tank 312 and primary tank 32. A liquid dyed brine B is gravity-filled into standpipe 382 until liquid stops dropping in pipe. When the liquid level is 1 to 2 feet above tank 30, and drops no more than ¼ inch in one quarter hour, the tank is considered brine-filled. Retrofit tank 30 is then entered through one of the manways 350 or 352. The interior of inner tank 312 in inspected for any signs of the dyed brine leaking through joints of inner tank 312. Any such leaking joints are then remanufactured.

In lieu of brine, a dry sensor may be installed in the tank. In this embodiment, a U-shaped channel of 3 ply thickness, which extends within the circumference of the inner tank, is installed over the center joint. The channel can be made by placing a trapezoidal form, such as was used with the ribs, about a mandrel and applying 3 plies of material to create a 360 degree channel. A cut is made in the channel and the form and channel are removed from the mandrel. The form is ripped free of overlying channel leaving the channel with the U-shaped configuration.

The channel is placed within the outer tank 32 with a drawstring located therein. Then circumferential layup 230 is placed over the channel. The channel cooperates with the panels of the trifolds to form a hollow, 360 degree, annular conduit. A hole is cut in the panels beneath hole 378 in outer tank 32 to provide access to the drawstring. The drawstring is used to pull the dry probe into place inside tank 30' to provide for monitoring of the tank. Conventional electronic apparatus can be attached to the dry probe provided for monitoring. Pressure monitors, where positive or negative air pressure are employed to monitor the annular space, may also be used. This invention contemplates that other leak sensing means could also be employed to monitor the annular space.

Figure 15A:
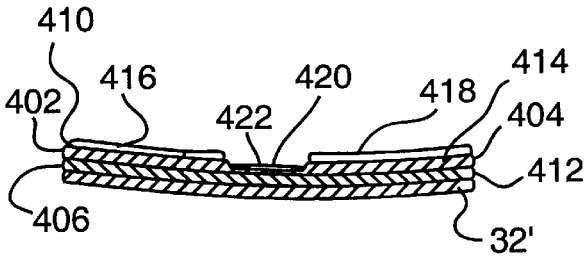
FIG. 15 *a–c* are sectional views of panels being laid up, in accordance with a second embodiment of the invention, which are used to form a double walled inner tank within the primary tank.

In another embodiment of the present invention, a multi-walled tank 400 may be installed, instead of single walled tank 312, within a primary tank 32' to form retrofit tank 30'. The construction of a multi-walled inner tank 400 is similar to that described above with respect to inner tank 312 with the following variations. As the construction is similar, only a fragmentary portion of retrofit tank 30, is shown in FIGS. 15 *a–c*.

Figure 15B:
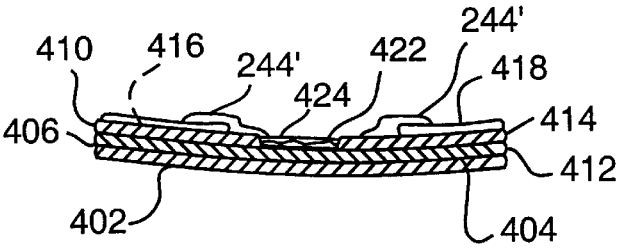
Figure 15C:
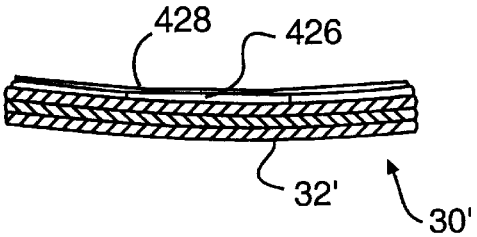

Arcuate panels 402 and 404 on panels of adjacent trifolds are shown in FIGS. 15 *a–c*. Panel 402 includes an outer wall 406 and an inner wall 410 interior to outer wall 406. Likewise, panel 404 has an outer wall 412 and an inner wall 414. Ideally, panels 402 and 404 are also made in a factory or production site.

During fabrication of panels 402 and 404, respective outer walls 406 and 412 are formed by spraying on a mold chopped fibers of fiberglass reinforced plastic and resin or by laying up 7 or other number of plies of alternating layers of mat/woven roving or mat in a conventional manner. A non-stick agent is then applied over the inner surfaces of walls 406 and 412, except at certain spaced apart locations. This can be accomplished by applying tape over these selected locations and then spraying the non-stick agent over the interior of outer walls 406 and 412. The covering tape is then removed leaving spots on walls 406 and 412 free of the anti-stick agent. Then inner walls 410 and 414 are sprayed up or laid up over outer walls 406 and 412. Ribs 416 and 418 are laid up onto inner walls 410 and 414 in the manner described in the first embodiment. Hinges can be attached to the these ribs 416 and 418 to allow the panels to be joined into trifolds.

Thus, the outer and inner walls will not be integral or bound with one another except at the discrete locations free of the anti-stick agent. The securement of the outer walls to the inner walls is, however, sufficient to hold the outer and inner walls of panels 402 and 404 together during handling and fabrication. Pressure in added between the walls in the field to separate the tank walls at the discrete locations. Because the inner and outer walls are not integrally connected, a pathway exists for fluid to pass between the inner and outer walls.

At the longitudinally and circumferentially extending edges of panels 402 and 404, inner walls 410 and 414 are set back from the edges of outer walls 406 and 412. This allows layups, such as layup 420 shown in FIG. 15*a*, to be applied over the abutting edges of outer wall 406 and 412. Next, a non-stick agent is sprayed or rolled over layup 420 to form an anti-stick layer 422. The thickness of layer 422 is exaggerated in FIG. 15*a* to demonstrate its presence.

An inner layup 424 is applied over layer 422 and inner walls 410 and 414 filling the gap therebetween. Finally, a rib portion 426 is installed using a layup 428. Alternatively, layup 244' or mats may be applied to the ends of ribs 416 and 418 instead of applying inner layup 424 and rib portion 426. This process of providing layups between the outer walls, the inner walls and alternatively adding rib portions 426 is continued until a multi-walled cylinder is formed within primary tank 32'.

Likewise, end caps are similarly constructed using panels having inner and outer walls with inner and outer layups and utilizing a non-stick agent such that inner and outer walls are only sporadically connected to one another until pressure is applied to complete separation. As described in the first embodiment, ribs will again be located on the inner surface of the panels and may be joined together using rib portions and layups to provide a plurality circumferentially continuous hoops or additonal material may be applied to provide support in lieu of the rib portions. Hinges also are utilized to join ribs together and to provide folding and unfolding action of panel 18 of trifolds during their installation into primary tank 30'.

While in the foregoing specification this invention has been described in relation to a certain preferred embodiment thereof, and many details have been set forth for the purpose of illustration, it will be apparent to those skilled in the art that the invention is susceptible to alteration and that certain other details described herein can vary considerably without departing from the basic principles of the invention.

For example, the inner tank could be constructed using discrete panels rather than using the trifolds with hinges connecting panels together. Also, the tank could be constructed without ribs. Rather, layups could be applied to the arcuate rectangular segments throughout the tank to replace the ribs having trapezoidal shaped forms with prefabricated layups which were constructed off-site from the retrofit operation.

What is claimed is:

1. An insert for use to retrofit an underground storage tank having an inner surface, the insert comprising:

a plurality of rigid arcuate panels having an outside surface, wherein at least two of the plurality of rigid arcuate panels are hingedly connected to another of the plurality of rigid arcuate panels; and the panels each include a plurality of circumferential reinforcing ribs;

wherein the panels can be folded together to form a compact configuration and can be unfolded to form a larger combined rigid arcuate surface such that the folded insert can be introduced into the underground storage tank, and can be unfolded within the underground storage tank to line a portion of the inner surface of the underground storage tank.

2. The insert of claim 1, wherein said rigid arcuate panels are fiberglass panels.

3. The insert of claim 1, wherein the plurality of rigid arcuate panels is a trifold comprising a central panel hingedly joined to a pair of lateral panels.

4. The insert of claim 1, wherein at least two of the plurality of rigid arcuate panels are connected to another of the plurality of rigid arcuate panels using at least one hinge.

5. The insert of claim 1, further comprising a pair of longitudinal spaced-apart bands strapped around the periphery of the trifold to maintain the trifold in a compact folded-up state.

6. A retrofit underground storage tank comprising:

an outer primary tank having an inner surface; a plurality of discrete arcuate panels arranged circumferentially within the outer primary tank to line the inner surface of the outer primary tank, each of said arcuate panels having a plurality of circumferential reinforcing ribs; and a plurality of longitudinal layup joints joining circumferentially adjacent arcuate panels together;

wherein the layup joints seal the joints between the arcuate panels to form a rigid, structurally self-supporting, fluid-tight inner tank within the outer primary tank.

7. The retrofit tank of claim 6, wherein the panels are laid up and joined together forming a multi-walled inner tank within the primary tank.

8. The retrofit tank of claim 6 further comprising:

a monitoring apparatus disposed between the inner tank and the outer tank to monitor the leakage of fluid in the space located between the inner and outer tanks.

9. The retrofit tank of claim 6, wherein the outer tank further includes an access opening therein;

a fiberglass reinforced covering panel covering the outer tank; and layups fluidly sealing the covering panel to the outer tank to prevent leakage therebetween.

10. The retrofit underground storage tank of claim 6, wherein the arcuate panels are fiberglass arcuate panels.

11. The retrofit underground storage tank of claim 6, wherein the circumferential reinforcing ribs form a circumferentially continuous integral reinforcing hoop extending around the tank.

12. The retrofit underground storage tank of claim 6, further comprising circumferential layup joints joining longitudinally adjacent arcuate panels to each other.

13. The retrofit underground storage tank of claim 6, further comprising at least one end cap, each such end cap comprising a plurality of end cap panels, and at least one layup joining the end cap panels to each other.

* * * * *

UNITED STATES PATENT AND TRADEMARK OFFICE

CERTIFICATE OF CORRECTION

PATENT NO. : 5,816,424
DATED : October 6, 1998
INVENTOR(S) : Cannan, Jr. et al.

It is certified that error appears in the above-identified patent and that said Letters Patent is hereby corrected as shown below:

Related U.S. Application Data,
Line 2, "which is a continuation of Ser. No. 389,298" should read -- which is a continuation in part of Ser. No. 389, 298 --

References Cited,
Patent No. "5,054,035" should read -- 5,054, 635 --

Signed and Sealed this

Twenty-first Day of August, 2001

*Attest:*

Nicholas P. Godici

NICHOLAS P. GODICI
*Acting Director of the United States Patent and Trademark Office*

*Attesting Officer*